US008813399B2

(12) United States Patent
Miedema et al.

(10) Patent No.: US 8,813,399 B2
(45) Date of Patent: Aug. 26, 2014

(54) COMPACT LED LIGHT MODULE

(75) Inventors: Gregory A. Miedema, Spring Lake, MI (US); Denis P. Igoe, Livonia, MI (US)

(73) Assignee: CSE, Inc., Grand Rapids, MI (US)

( * ) Notice: Subject to any disclaimer, the term of this patent is extended or adjusted under 35 U.S.C. 154(b) by 0 days.

(21) Appl. No.: 13/020,851

(22) Filed: Feb. 4, 2011

(65) Prior Publication Data

US 2011/0185609 A1 Aug. 4, 2011

Related U.S. Application Data

(60) Provisional application No. 61/301,399, filed on Feb. 4, 2010.

(51) Int. Cl.
*G09F 13/00* (2006.01)

(52) U.S. Cl.
CPC ..... *G09F 13/00* (2013.01)
USPC ..... 40/549; 40/541; 362/294; 362/237; 362/311.02

(58) Field of Classification Search
USPC ..... 40/544, 570, 549
See application file for complete search history.

(56) References Cited

U.S. PATENT DOCUMENTS 4,254,453 A * 3/1981 Mouyard et al. ..... 362/240
4,967,317 A * 10/1990 Plumly ..... 362/613
5,299,109 A * 3/1994 Grondal ..... 362/241
5,857,767 A 1/1999 Hochstein
6,045,243 A 4/2000 Muth et al.
6,058,634 A * 5/2000 McSpiritt ..... 40/452
6,154,945 A * 12/2000 Voelzke ..... 29/426.5
6,375,340 B1 4/2002 Biebl et al.
6,502,956 B1 * 1/2003 Wu ..... 362/237
6,666,563 B2 12/2003 Brown
6,945,683 B2 9/2005 Gross et al.
7,121,675 B2 10/2006 Ter-Hovhannisian
7,128,442 B2 10/2006 Lee et al.
2004/0107615 A1 * 6/2004 Pare ..... 40/544
2004/0264195 A1 12/2004 Chang et al.
2005/0157500 A1 7/2005 Chen et al.
2006/0059742 A1 * 3/2006 Pan ..... 40/544
2006/0092637 A1 5/2006 Yeh (Continued)

FOREIGN PATENT DOCUMENTS

WO WO 2007099860 A1 * 9/2007

OTHER PUBLICATIONS

International Search Report completed Sep. 14, 2011, from corresponding International Application No. PCT/ US2011/023663.

(Continued)

*Primary Examiner* — Kristina Junge
(74) *Attorney, Agent, or Firm* — Gardner, Linn, Burkhart & Flory, LLP

(57) ABSTRACT

A modular LED light unit for mounting to an object to illuminate distally located objects comprises a circuit board supporting a plurality of LED lights and a light permeable front cover. The circuit board includes a plurality of apertures with the LED lights being reverse mounted to the circuit board such that each LED light is located by and extends into a separate one of the apertures. The front cover includes an outer surface and an inner surface and at least one optical structure located on the outer surface or inner surface. At least one of the LED lights is axially aligned with the optical structure whereby light emitted from the aligned LED lights is directed into the optical structure.

22 Claims, 10 Drawing Sheets

(56) References Cited

U.S. PATENT DOCUMENTS

| | | | | |
|---|---|---|---|---|
| 2008/0078733 | A1 | 4/2008 | Nearman et al. | |
| 2009/0010026 | A1* | 1/2009 | Gai | 362/609 |
| 2009/0213583 | A1* | 8/2009 | Chang et al. | 362/218 |
| 2009/0296388 | A1 | 12/2009 | Wu et al. | |
| 2010/0073928 | A1* | 3/2010 | Kim et al. | 362/245 |
| 2010/0219760 | A1* | 9/2010 | Tanaka et al. | 315/152 |

OTHER PUBLICATIONS

Written Opinion of the International Searching Authority for International Application No. PCT/US2011/023663.

* cited by examiner

COMPACT LED LIGHT MODULE

CLAIM OF PRIORITY

The present application claims priority of U.S. provisional application Ser. No. 61/301,399, filed Feb. 4, 2009, by Gregory A. Miedema and Denis P. Igoe for COMPACT LED LIGHT MODULE, which is hereby incorporated herein by reference in its entirety.

BACKGROUND OF THE INVENTION

The present invention is directed to a light module, and in particular to a compact LED light module.

Lighting is necessary in a broad array of applications, including interior residential and commercial lighting, cabinetry and office furniture lighting, and lighting of residential and commercial appliance units. LED lighting is known, but may require numerous LED lights to obtain the proper lighting for a given application or otherwise provide inadequate lighting of distally located objects.

SUMMARY OF THE INVENTION

The present invention provides a compact light module utilizing LED lights that are optically aligned with optical structures located on a front cover or front cover assembly to provide a more efficient use of the light output of the light assembly for a lighting application.

According to an aspect of the present invention, a modular LED light unit for mounting to an object to illuminate distally located objects comprises a circuit board supporting a plurality of LED lights and a light permeable cover having an outer surface and an inner surface, with the front cover including at least one optical structure located on one of the outer surface or inner surface. At least one of the LED lights is axially aligned with and in substantial proximity to the optical structure whereby light emitted from the LED light is directed into the optical structure.

According to another aspect of the present invention, a modular LED light unit for mounting to an object to illuminate objects distally located from the light unit comprises a circuit board supporting a plurality of LED lights, and a light permeable front cover having an outer surface and an inner surface. The front cover includes at least one optical structure defining a protuberance relative to the inner surface with the optical structure protruding toward the circuit board, with the optical structure including a receptacle defining a void in the optical structure that extends away from the circuit board. The receptacle includes a receptacle opening and at least one of the LED lights is axially aligned with and in substantial proximity to the receptacle opening whereby light emitted from the LED light is directed into the receptacle whereby the optical structure aids in channeling the emitted light through the front cover. The modular LED light unit may comprise a plurality of optical structures with each receptacle of each optical structure aligned with and in substantial proximity to at least one LED light. Alternatively, each receptacle of at least a portion of the optical structures may be aligned with and in substantial proximity to separate ones of the LED lights.

In particular embodiments the modular LED light unit comprises a plurality of generally frustoconical optical structures, each of which includes a top portion with the receptacle opening being formed on the top portion and the receptacles of the frustoconical optical structures being generally cylindrical, and wherein each frustoconical optical structure is aligned with and in substantial proximity to separate ones of the LED lights. The frustoconical optical structures may have rounded sidewalls tapering from the inner surface to the top portion or receptacle opening. Alternatively, an optical structure may be formed as an elongated optical structure having rounded sidewalls tapering from the inner surface to the top portion or receptacle opening, with the receptacle defining a channel in the elongated optical structure.

The light module may include a front cover assembly comprising an outer lens defining the outer surface and inner surface, with at least one optical structure being a separable optical structure that is not integrally formed with the outer lens, but contacts the inner surface of the outer lens when assembled.

According to another aspect of the present invention, a modular LED light unit for mounting to an object to illuminate distally located objects comprises a circuit board supporting a plurality of LED lights and a light permeable front cover having an outer surface and an inner surface. The front cover includes a plurality of generally frustoconical optical structures integrally formed on the front cover defining protuberances relative to the inner surface, with the optical structures protruding toward the circuit board. Each optical structure includes a generally cylindrical receptacle defining a void in the optical structure with the receptacle extending away from the circuit board and including a generally circular receptacle opening. Each optical structure is axially aligned with and in substantial proximity to separate ones of the LED lights whereby light projected by aligned LED lights is directed into the receptacles of the optical structures thereby channeling the projected light through the front cover. In particular embodiments the frustoconical optical structures have rounded sidewalls tapering from the inner surface to the top portion or receptacle opening.

According to yet another aspect of the present invention, a modular LED light unit for mounting to an object to illuminate distally located objects comprises a circuit board supporting a plurality of LED lights and a light permeable front cover. The circuit board includes a plurality of apertures with the LED lights being reverse mounted to the circuit board such that each LED light is located by and extends into a separate one of the apertures. The front cover includes an outer surface and an inner surface and at least one optical structure located on the outer surface or inner surface. At least one of the LED lights is axially aligned with the optical structure whereby light emitted from the aligned LED lights is directed into the optical structure.

In particular embodiments the LED light unit may be approximately 7 mm thick and may include a plurality of optical structures, with each optical structure being aligned with and in substantial proximity to at least one LED light or separate LED lights. The LED light unit may also include a heat sink that contacts a back surface of each LED light and in particular embodiments the heat sink may also function as a back cover for the LED light unit. Either the front cover or the circuit board may include an alignment member, with the other of the front cover and the circuit board including an alignment aperture that projects into the alignment aperture to aid the positional locating of the front cover relative to the circuit board.

Also in particular embodiments, the apertures in the circuit board may define a circular opening with the LED lights having a circular profile and the diametrical clearance of the LED lights relative to the apertures being approximately 0.1 to 0.3 μm. The optical structures may define a protuberance relative to the inner or outer surfaces of the front cover. Still further, the optical structure may protrude toward the circuit board and include a receptacle defining a void in the optical structure with the receptacle including a receptacle opening.

In still further embodiments, the circuit board may include a design surface that is at least partially visible through the front cover with the design surface being free of electrical architecture and electronic identifiers. The design surface may include solid colors, patterns, or a design indicia. The LED light unit may include a frame defining an inner perimeter, with the design surface being substantially bounded by the inner perimeter.

The circuit board in any of the above embodiments may include a plurality of apertures with the LED lights being reverse mounted to the circuit board such that each LED light extends into a separate one of the apertures, and the back cover may comprise a heat sink with the LED lights contacting the heat sink. Also in any of the above embodiments, either the front cover or the circuit board may include an alignment member with the other of the front cover or circuit board including an alignment aperture where the alignment member projects into the alignment aperture thereby aiding the positional locating of the front cover relative to the circuit board. In any of the above embodiments, the front cover may include one or more optical effectors on the inner surface that are positioned adjacent an optical structure for refracting light projected from one or more of the LED lights.

Light modules in accordance with the present invention with LED lights that are optically aligned with receptacles of optical structures decrease the waste of light caused by the divergence of projected light, thereby improving the efficiency of the light module by capturing, directing, and/or channeling the projected light through the front cover to provide an acceptable lighting structure for a given application while minimizing the cost. The LED lights are optically aligned with and mounted in substantial proximity to the optical structures such that projected light is directed into a receptacle of the optical structure for directing or channeling the projected light through the front cover. The light modules are usable, for example, as under cabinet lighting, recessed ceiling or wall lighting, as well as an appliance light unit, or other such lighting unit, and may be installed as original equipment or retrofitted to existing structures and surfaces to provide a compact and efficient device for illuminating distally located objects.

These and other objects, advantages, purposes and features of this invention will become apparent upon review of the following specification in conjunction with the drawings.

DESCRIPTION OF THE PREFERRED EMBODIMENTS

Figure 1:
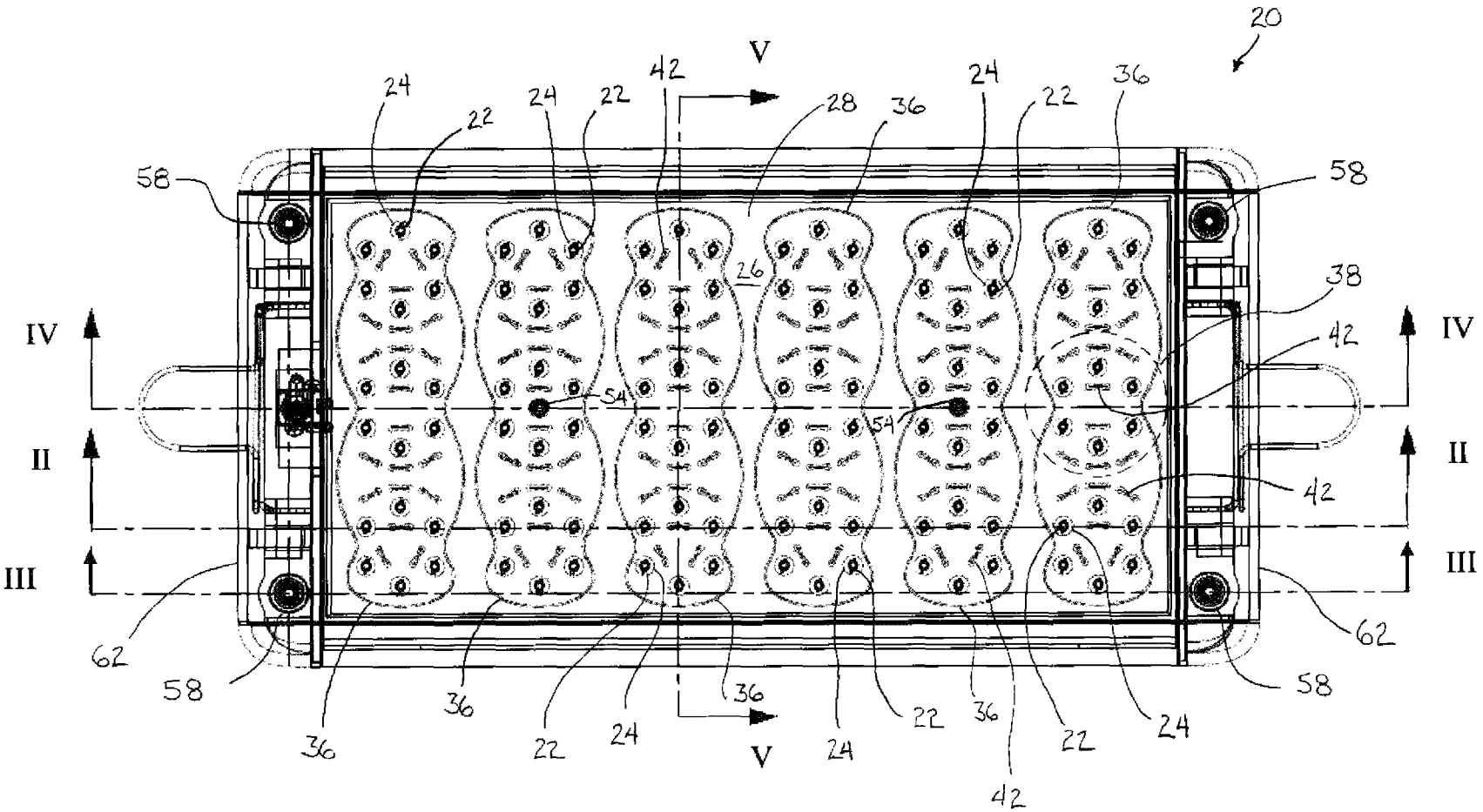
FIG. 1 is a top plan view of a light module in accordance with the present invention.
Figure 2:
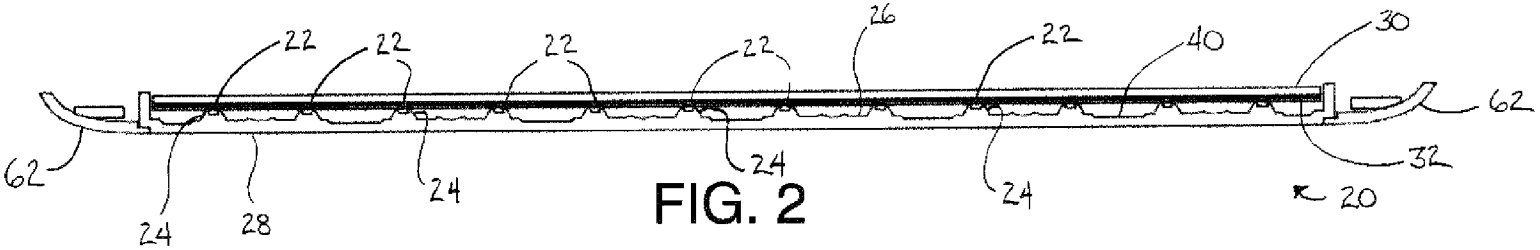
FIG. 2 is a side sectional view taken along the line II-II of FIG. 1.
Figure 3:
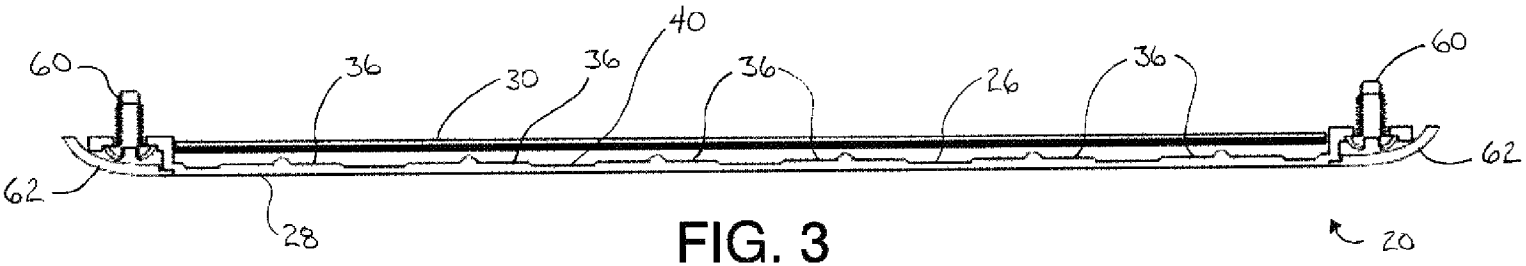
FIG. 3 is a side sectional view taken along the line III-III of FIG. 1.
Figure 4:
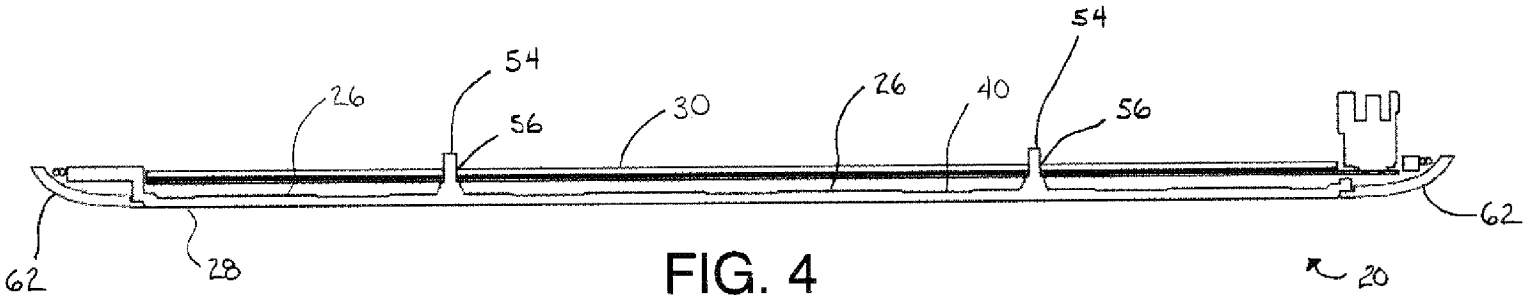
FIG. 4 is a side sectional view taken along the line IV-IV of FIG. 1.
Figure 5:
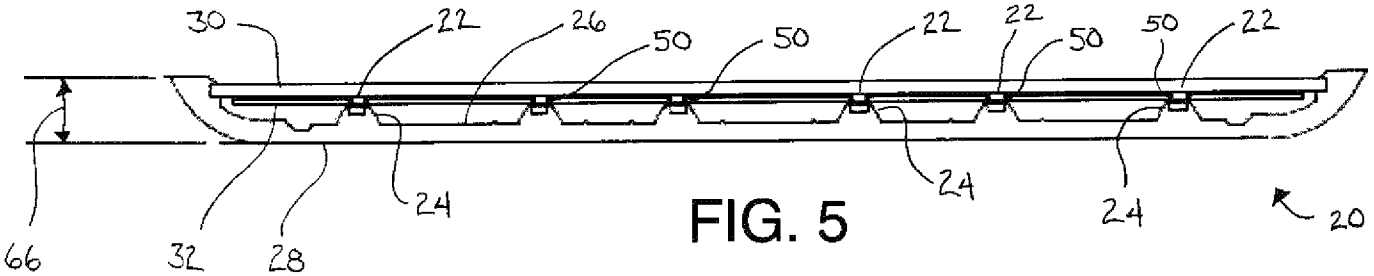
FIG. 5 is a side sectional view taken along the line V-V of FIG. 1.

The present invention will now be described with reference to the accompanying figures, wherein the numbered elements in the following written description correspond to like-numbered elements in the figures. A compact LED light module, fixture, or luminaire 20 in accordance with the present invention is disclosed in FIGS. 1-5, with light module 20 including multiple LED devices or lights 22 that project light into or at optical structures 24 (FIG. 6) positioned on the inside surface 26 of a light permeable front cover 28. Light module 20 further includes a back cover defined by a heat sink 30 and a circuit board 32 to which LED lights 22 are affixed, with circuit board 32 and LED lights 22 located between front cover 28 and heat sink 30. LED lights 22 are optically aligned with and mounted in substantial proximity to optical structures 24 such that light projected from lights 22 is directed into a receptacle 34 of optical structures 24 whereby optical structures 24 aid in directing or channeling the projected light through front cover 28, thereby reducing the loss or waste of light caused by the divergence of projected light and improving the focus of light projected from light module 20. Light module 20 thus provides a compact and higher efficient device for illuminating distally located objects with a lower cost and may be used, for example, as an under cabinet light, a recessed ceiling or wall light, an appliance light unit, such as a refrigerator, washer, or dryer light unit, or other such lighting unit.

In the embodiment of FIGS. 1-5, front cover 28 is translucent and optical structures are integrally formed on inside surface 26, such as by a molding process. Front cover 28 includes six optical areas 36, with each area 36 including three sets 38 of six optical structures 24 arranged in a generally circular or hexagonal configuration. As understood from FIGS. 2-4, each optical area 36 is slightly elevated relative to the lower portion 40 of inside surface 26. Also included on each optical area 36 of inside surface 26 in the illustrated embodiment of FIGS. 1-5 are multiple, generally barbell shaped light or optical effectors 42 protruding upward from the inner surface 26 of front cover 28. Optical effectors 42 are distributed both about and within the generally circular or hexagonal arranged sets 38 of optical structures 24, the function of which is discussed below.

Figure 6:
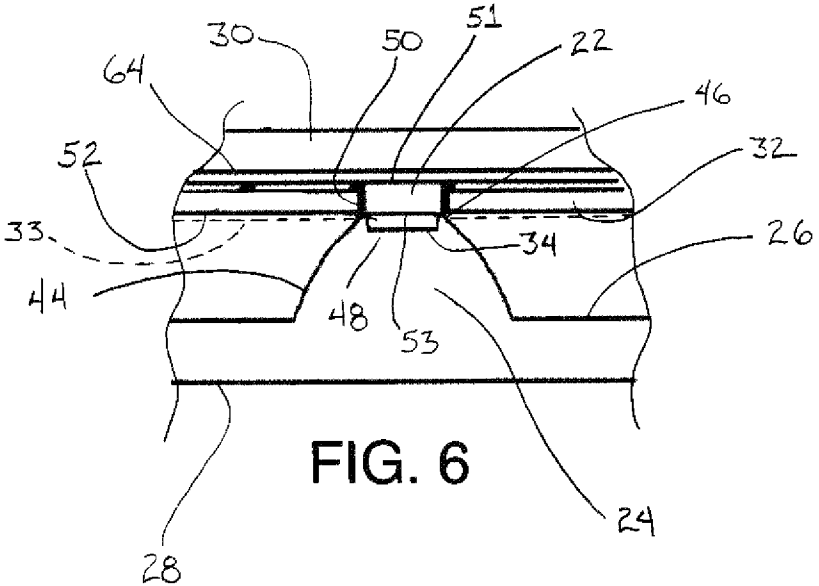
FIG. 6 is a close up partial side sectional view of an optical structure relative to an LED light and circuit board of the light module of FIG. 1.

Referring now to FIG. 6, each optical structure 24 protrudes from inner surface 26 of front cover 28 toward circuit board 32 and LED lights 22, with optical structure 24 being generally frustoconical in configuration with a rounded or tapered sidewall 44 extending to a top portion 46. Receptacle 34 is positioned at the distal end or top portion 46 of optical structure 24 relative to inner surface 26 and defines a receptacle opening 48 that is axially aligned with and opens toward and adjacent LED light 22, with receptacle 34 being generally cylindrical and extending into optical structure 24 away from LED light 22. As also understood from FIG. 5, circuit board 32 includes multiple round apertures 50 through which LED lights 22 are positioned in a reverse mounted or back mounted configuration such that the backside or back surface 51 of each LED light 22 is directly securable to heat sink.

Apertures 50 may be used to locate and/or position LED lights 22. In the illustrated embodiment, the diameter of aperture 50 is approximately 0.2 mm greater than the diameter of LED light 22, with aperture 50 having a diameter of approximately 2.1 mm, LED light 22 having a cross sectional diameter of approximately 1.9 mm, and receptacle opening 48 having a cross sectional diameter that is slightly smaller than the diameter of LED light 22. In addition, optical structures 24 have a height of approximately 2.0 mm with sidewalls 44 having a radius of approximately 5.0 mm. Also in the illustrated embodiment, LED light 22 is positioned within aperture 50 such that light emitting end 53 of LED light 22 is generally flush with surface 52 of circuit board 32. LED light 22 and receptacle opening 48 are in substantial proximity to each other, with LED light 22 being slightly spaced from or may even contact optical structure 24. In alternative arrangements, the diametrical clearance between the LED lights and the circuit board apertures within which the LED lights are mounted may be in the range of approximately 0.1 to 0.3 mm.

Circuit board 32 is an opaque printed circuit board ("PCB") and surface 52 may be coated, graphically treated, colored, or painted, or include an overlay 33 (FIG. 6), such as for aesthetic purposes, such as to mask its appearance as viewed through front cover 28, with the circuitry (not shown) of circuit board 32 being located on the side opposite surface 52. In the illustrated embodiment, circuit board 32 is constructed of FR-4 glass reinforced epoxy laminate, and may be substantially thin such that it is flexible.

Light projected from LED lights 22 will be substantially directed out of apertures 50 and toward or into receptacles 34 of optical structures 24. The alignment and proximity of optical structures 24 to LED lights 22 and the geometric configuration of optical structures 24 aids in collecting and directing light projected from LED light 22 through front cover 28 to reduce the waste or spread of the projected light thereby increasing the efficiency of light module 22. For example, the construction and configuration of optical structures 24 relative to LED lights 22 effectively increases the luminous efficacy or luminous efficiency of light module 20 due to the collection of light into optical structure 24. Accordingly, light module 20 provides a more efficient use of the lumen output of LED lights 22 whereby sufficient luminosity is provided while reducing the cost. Light effectors 42 are employed to provide a graphical or decorative effect and to further impact light projected through front cover 22, with light effectors 42 creating a hallo or sparkle effect, which may be beneficial to reduce any potential eye strain that may otherwise result for some viewers if the viewers were to look directly at light module 20.

Apertures 50 in circuit board 32 are used to align LED lights 22 with optical structures 24 via the assembly of front cover 28, circuit board 32, and heat sink 30 together. Moreover, referring to FIGS. 1 and 4, front cover further includes two alignment members, which in the illustrated embodiment comprise pins 54 extending from inner surface 26 toward circuit board 32 and heat sink 30, with circuit board 32 and heat sink 30 including alignment apertures formed as holes 56. When light module 20 is assembled, alignment pins 54 extend into alignment holes 56 to aid in aligning optical structures 24 with LED lights 22. Alternatively, alignment apertures could be located in a front cover with alignment members extending from a circuit board. In any embodiment, the alignment members may be integrally fixed or may comprise loose pins that are inserted into apertures. Front cover 28 further includes mounting holes 58 through which fasteners 60 are extended to mount light module 20 to a surface. A pair of removable end caps 62, which may be of generally similar materials as used for front cover 28, are attached to light module 20 after mounting to a surface to cover the mounting fasteners 60.

Referring again to FIG. 6, a thermally conductive adhesive 64 is used to secure LED lights 22 to heat sink 30, where heat sink 30 is constructed as an extruded and powder coated aluminum member. The overall installed height 66 of light module 20 is approximately 7.2 mm such that light module 20 may be conveniently mounted to surfaces without the need for recessing components into the surface. Although not shown, light module 20 may include a battery pack and/or may include wiring for receiving an electrical current, Light module 20 may also include a switch or a touch sensitive pad to turn the LED lights on and off, or to adjustably dim the LED lights.

Figure 7:
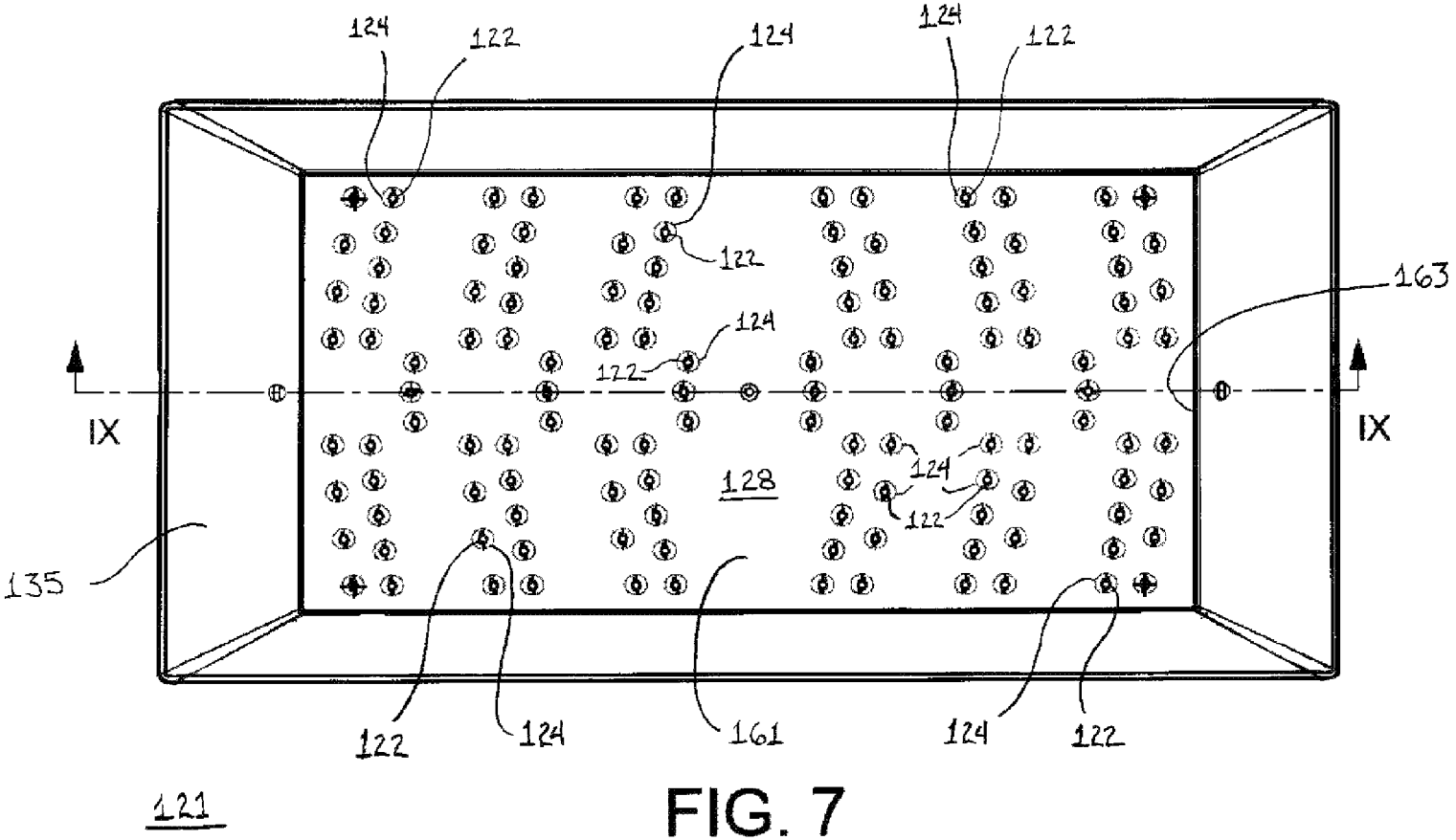
FIG. 7 is a top plan view of an alternative light module in accordance with the present invention.
Figure 8:
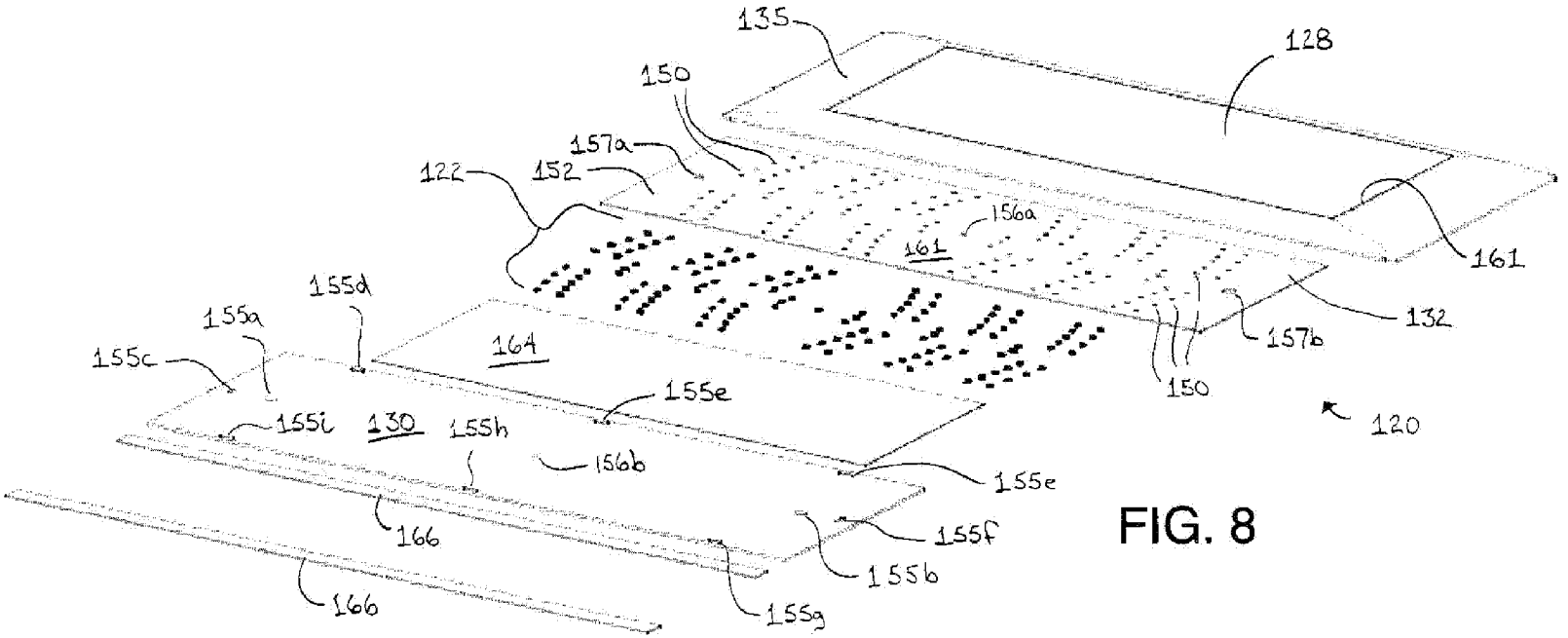
FIG. 8 is an exploded perspective view of the light module of FIG. 7.
Figure 9:
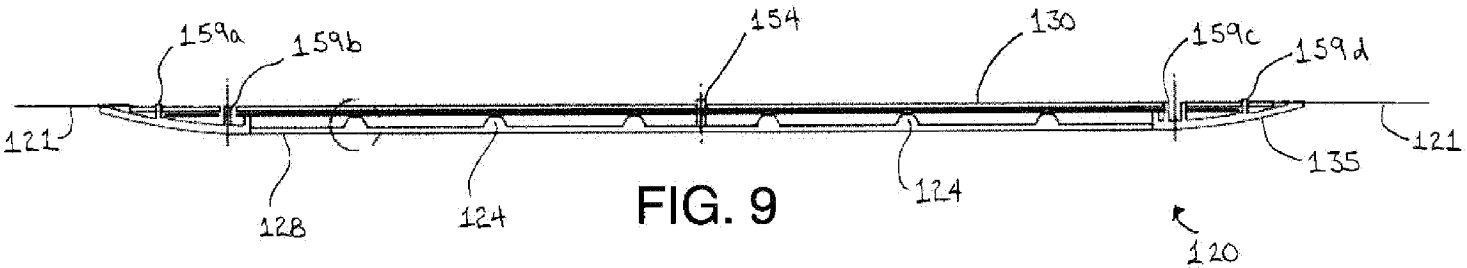
FIG. 9 is a sectional view of the light module of FIG. 7 taken along the line IX-IX.

Referring now to FIGS. 7-9, an alternative light module 120 in accordance with the present invention is disclosed that is of generally similar construction to light module 20 discussed above, with similar elements or features of light module 120 being identified with similar reference numerals with respect to light module 20, but with the prefix "1" added to the reference indicators. Because of the similarities of light module 120 with light module 20, not all of the like referenced components will be discussed. As illustrated, light module 120 is shown mounted to a surface 121 (FIGS. 7 and 9), such as a surface of a cabinet, a wall or ceiling surface, or a surface of an appliance, such as the interior of a refrigerator. The thin profile of light modules 20 and 120 enables the providing of lighting in a minimal amount of space.

Light module 120 includes a front cover 128, a circuit board 132, multiple LED lights 122 that are reverse mounted to circuit board 132, a heat sink 130, and a thermally conductive adhesive member 164 for securing the LED lights 122 to the heat sink 130. Also included is a bezel frame 135 shown with front cover 128 already disposed therein. Front cover 128 includes multiple optical structures 124 (FIG. 7) that are of substantially similar configuration and arrangement relative to LED lights 122 as optical structures 24 and LED lights 22 of light module 20. Front cover 128 does not include, however, elevated optical areas and optical effectors and employs an alternative arrangement of optical structures 124 and LED lights 122 relative to light module 20.

Front cover 128 includes a single alignment member formed as pin 154, with circuit board 132 including a corresponding alignment aperture formed as hole 156*a* and heat sink 130 including a corresponding alignment hole 156*b*. Circuit board 132 includes additional alignment apertures 157*a*, 157*b* and heat sink 130 includes additional alignment apertures 155*a*-155*j* through which various projections, such as projections 159*a*, 159*b*, 159*c*, 159*d* of frame 135 are located for assisting in the alignment of optical structures 124 with apertures 150 of circuit board 132 and, correspondingly, with LED lights 122. Although not shown, a plug or wires may extend out of or adjacent to heat sink 130 to provide power to circuit board 132.

Adhesive member 164 is a low thermal resistant adhesive layer, such as a BOND-PLY adhesive sheet supplied by the Bergquist Company of Minnesota, that is sandwiched between heat sink 130 and LED lights 122, with heat sink 130 being heat staked in place. As an alternative to an adhesive sheet, a spray adhesive may be employed. Lighting module has a height 166 of approximately 6.6 mm when assembled and may be mounted or affixed to a surface by way of mounting tape 168, such as double sided tape.

In like manner to surface 52 of light module 20, surface 152 of circuit board 132 may be coated, graphically treated, colored, or painted, or include an overlay, such as for aesthetic purposes, as viewed through front cover 128 to form a design surface or decorative area 161, with the circuitry (not shown) of circuit board 132 being located on the side opposite surface 152. In such an embodiment, surface 152 includes a decorative area 161 bounded by the interior perimeter 163 of bezel frame 135 and within decorative area 161 of circuit board 132, surface 152 does not include electrical architecture, such as soldering posts, etched conductive paths or circuit board components, nor are there any electronic identifiers, such as codes or labels for electronic components. Rather, in the illustrated reverse mounted embodiment of circuit board 132, only LED lights 122 are visible through apertures 150 in circuit board 132. Surface 152 may therefore be used for decorative, stylistic, and/or marketing treatments. For example, surface 152 and bezel frame 135 may be coordinated to have matching or coordinating colors. Moreover, the colors of surface 152 and bezel frame 135 may be selected to match the color of a surface to which light module 120 is to be mounted, such as surface 121 (FIGS. 7 and 9). As noted, surface 121 may be the surface of an appliance, such as an interior wall or liner of a refrigerator, or the like, or may be a ceiling or other interior or exterior building surface, or a cabinetry surface. Examples of coloring for decorative area 161 of surface 152 and bezel frame 135 may include white, black or a faux stainless steel or chrome color, such as may be used in association with an appliance. Decorative area 161 of surface 152 may be colorized via a solder mask, Mylar film, paint and/or the like, including such as the material of circuit board 132 itself being colorized.

Still further, decorative area or design surface 161 of surface 152 may include design indicia such as graphics, patterns, words and/or images. Examples of design indicia may include, for example, floral or graphical patterns, corporate or sport logos and/or trademarks, as well as cartoon, book or other fictional characters, or other children themed designs, and as well as human and animal likenesses, names, and/or images. Bezel frame 135 may also be clear and/or front cover 128 may be clear, translucent, tinted, or frosted. Front cover 128 may also be textured.

Figure 10:
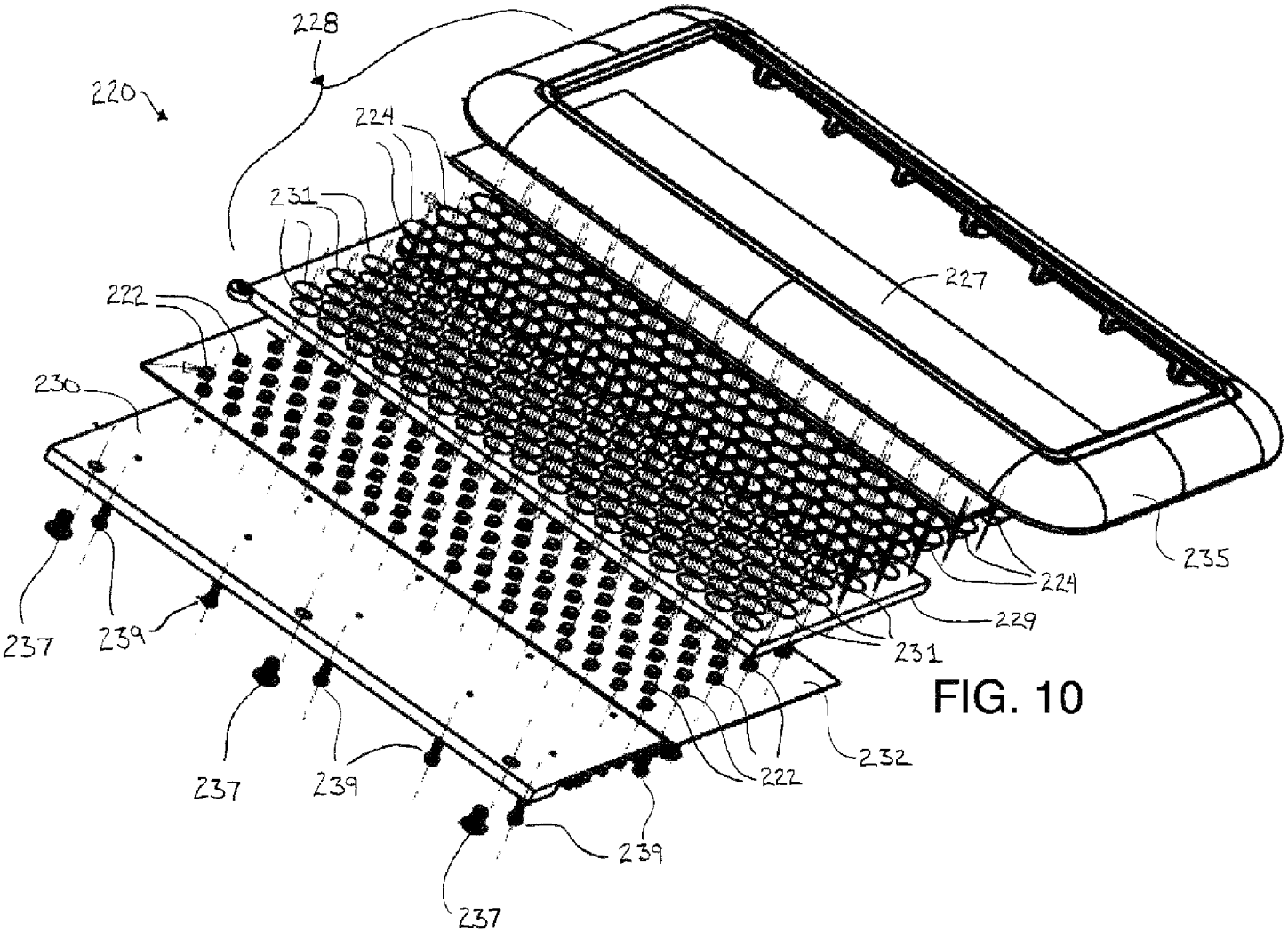
FIG. 10 is an exploded perspective view of another light module in accordance with the present invention.
Figure 11:
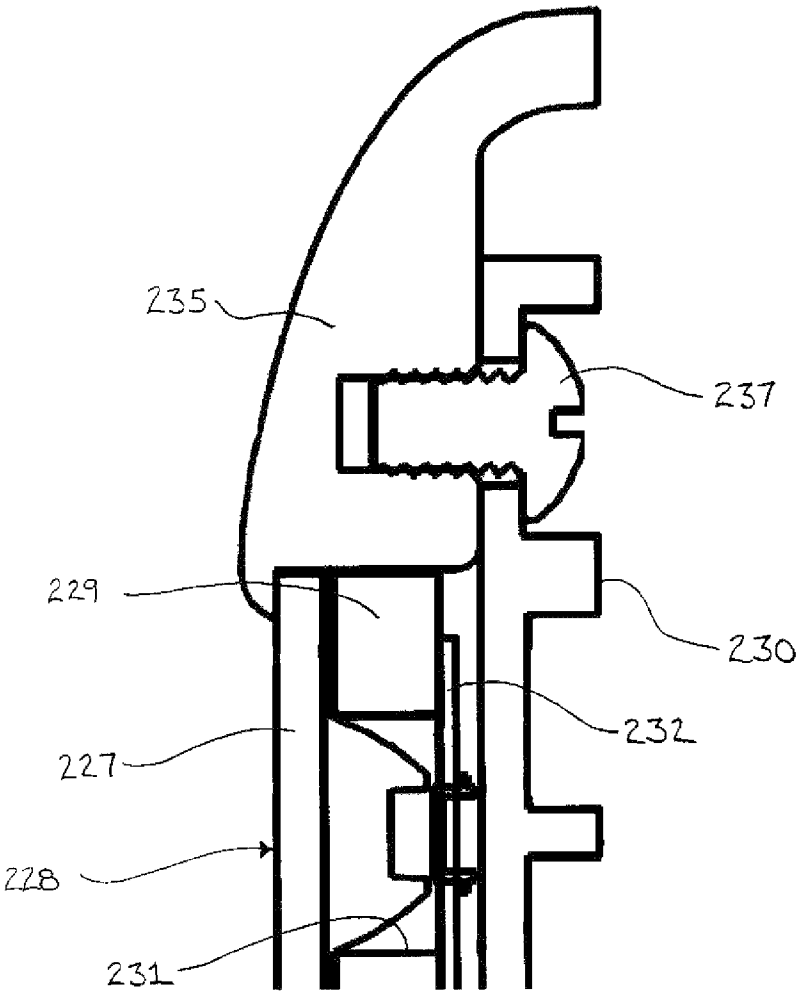
FIG. 11 is a close up partial side sectional view of the light module of FIG. 10.

Referring now to FIGS. 10 and 11, still another light module 220 in accordance with the present invention is disclosed that is of generally similar construction to light modules 20 and 120 discussed above, with similar elements or features of light module 220 being identified with similar reference numerals with respect to light module 20 and 120, but with the prefix "2" added to the reference indicators. Because of the similarities of light module 220 with light modules 20 and 120, not all of the like referenced components will be discussed.

Light module 220 includes a front cover assembly 228 comprising a planar outer lens 227, multiple optical structures 226 that are constructed separately from outer lens 227, and a spacer block 229. Optical structures 224 are generally similar to optical structures 24 and 124, but are not integrally and unitarily formed with outer lens 227. As understood from FIG. 10, spacer block 229 includes retaining holes 231 within which the optical structures 224 are located for aligning and maintaining their orientation relative to circuit board 232 and to the LED lights 222 mounted on circuit board 232. Heat sink 230 and bezel frame 235 are secured together via threaded fasteners 237, with optical structures 224, spacer block 229, circuit board 232, and LED lights 222 located there between. Separate alignment members formed as pins 239 are used to additionally locate heat sink 230, circuit board 232, and spacer block 229 together.

Figure 12:
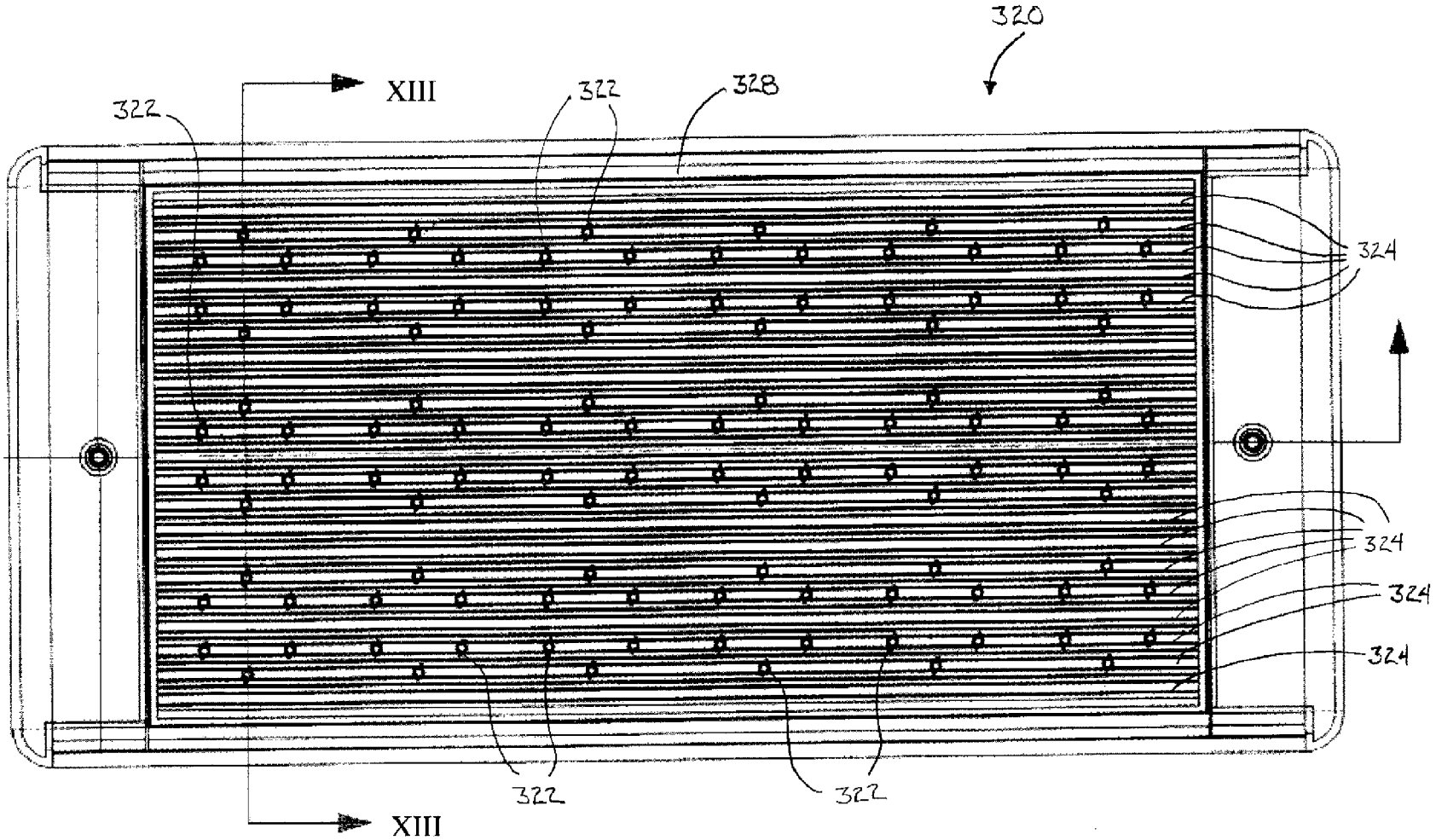
FIG. 12 is a top plan view of yet another light module in accordance with the present invention.
Figure 13:
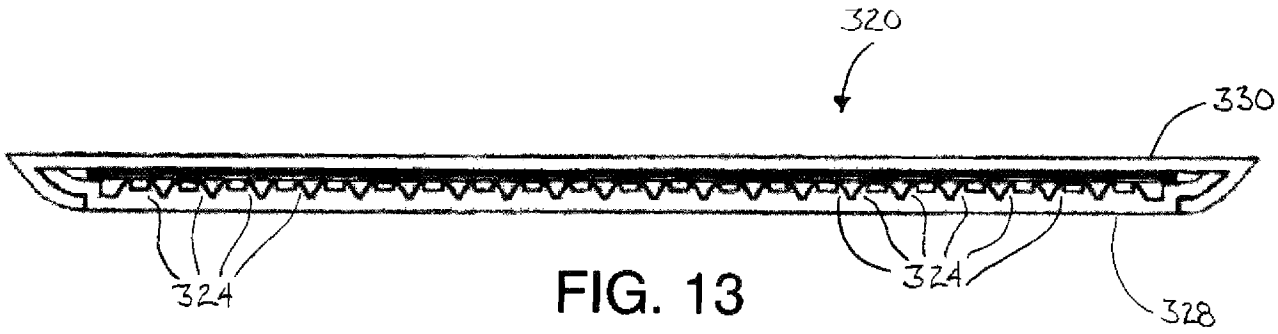
FIG. 13 is a side sectional view of the light module of FIG. 12 taken along the line XIII-XIII.
Figure 14:
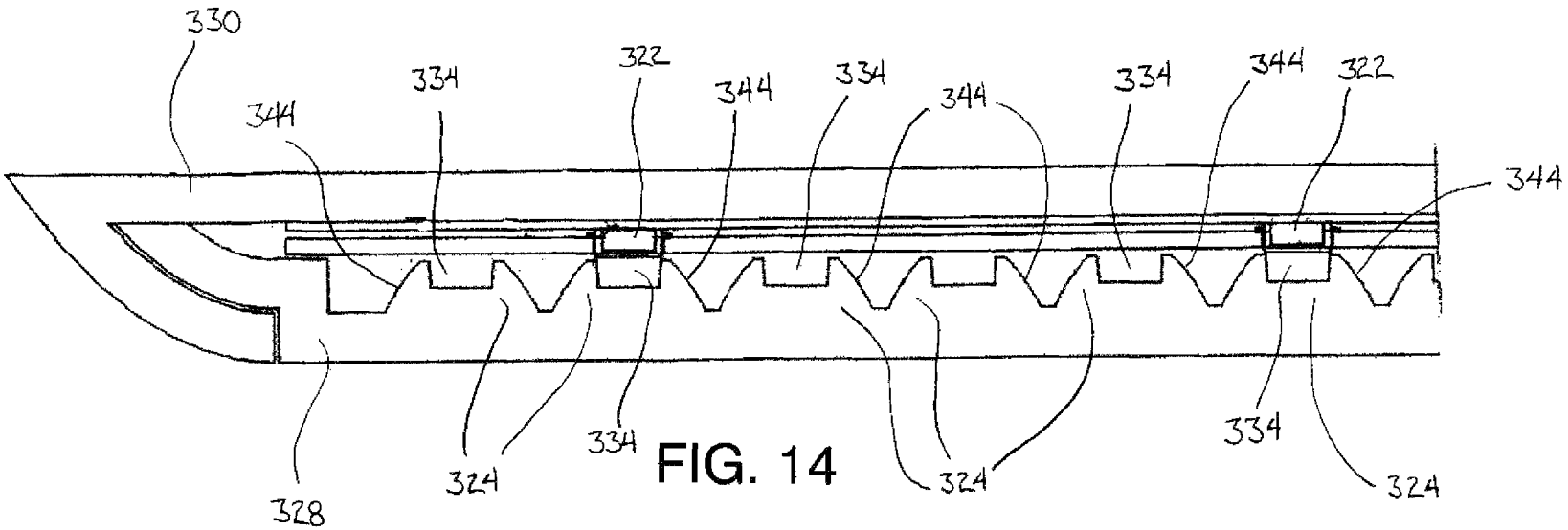
FIG. 14 is a partial side sectional view of an end of the light module of FIG. 13.

Referring now to FIGS. 12-14, still another light module 320 in accordance with the present invention is disclosed that is of generally similar construction to light modules 20, 120 and 220 discussed above, with similar elements or features of light module 220 being identified with similar reference numerals with respect to light module 20 and 120, but with the prefix "3" added to the reference indicators. Because of the similarities of light module 320 with light modules 20, 120 and 220, not all of the like referenced components will be discussed.

Light module 320 includes multiple optical structures 324, but unlike the generally frustoconical configuration of the above discussed optical structures, optical structures 324 of light module 320 are configured as an elongate member extending substantially the length of front cover 328, As understood from FIGS. 13 and 14, optical structures 324 include tapered or rounded sidewalls 344 and a receptacle 334 formed as a channel in optical structures 324. Optical structures 324 thus have a generally similar cross sectional profile relative to the profiles of optical structures 24, 124, and 224. Heat sink 330 of light module 320 forms the back cover of light module 320, with front cover 328 being constructed for sliding engagement with heat sink 330.

As understood from FIG. 12, light module 320 includes eighteen groupings of six generally circular or hexagonally arranged LED lights 322. Notably, not every optical structure 324 has an LED light 322 aligned therewith, but each optical structure 324 that is aligned with an LED light 322 has more than one LED light 322 aligned therewith, with either six or twelve LED lights 322 being aligned with a given optical structure 324. The elongate optical structures 324 also enable front cover 328 to be used with alternatively arranged or configured circuit boards having, for example, fewer or more lights, or alternatively arranged lights. This is because one or more LED lights may be aligned at various positions along the length of optical structures 324. This enables light structures to be constructed that provide differing light output and/or optical features.

Light modules having numerous alternative arrangements may be constructed in accordance with the present invention. For example, alternative numbers and arrangements of optical structures on front cover may be utilized to produce differing lighting structures producing more or less light. Optical structures may be arranged to form pictures or designs. Alternative elongate optical structures may be formed to be diagonal or have curves or bends, and/or not extend the entire length or width of the front cover, and/or elongate and generally frustoconical optical structures may be employed together on a light module. The construction and/or spacing of optical structures may be arranged to provide optical isolation of LED lights from each other whereby light projected from one or more LED lights is inhibited from overlapping with light projected from other LED lights. As discussed above, optical structures may be integrally formed as part of a front cover, or fixedly attached thereto, or may be separately formed. Optical structures may be formed of a different material such as, for example, a material having a different refractive index relative to the material forming the inner surface of the front cover or front cover assembly. Moreover, instead of a receptacle of an optical structure having a generally flat internal bottom surface, such as receptacle 34 of optical structure 24 (FIG. 6), an optical structure may have a rounded bottom, which in the case of a generally cylindrical optical structure would be generally concave. Still further, alternatively configured optical structures defining protuberances on the inner surface of a front cover may also be employed within the present invention relative to generally frustoconical optical structures, such as optical structures 24. For example, an alternative optical structure may have alternatively shaped side walls such that it is not rounded and/or may include grooves. Alternatively constructed and arranged optical effectors may also be employed to obtain different lighting effects or light diffraction.

Figure 15:
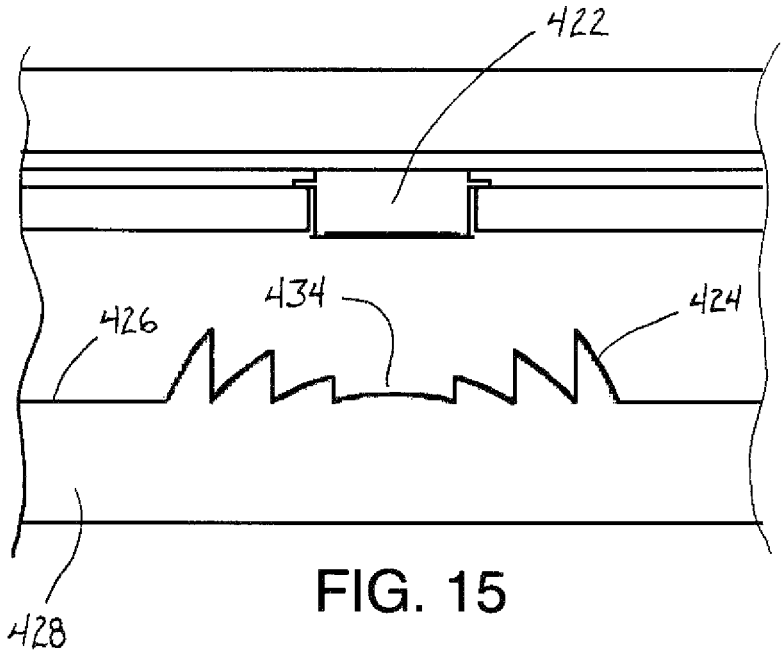
FIG. 15 is a close up partial side sectional view of an alternative optical structure in accordance with the present invention relative to an LED.
Figure 16:
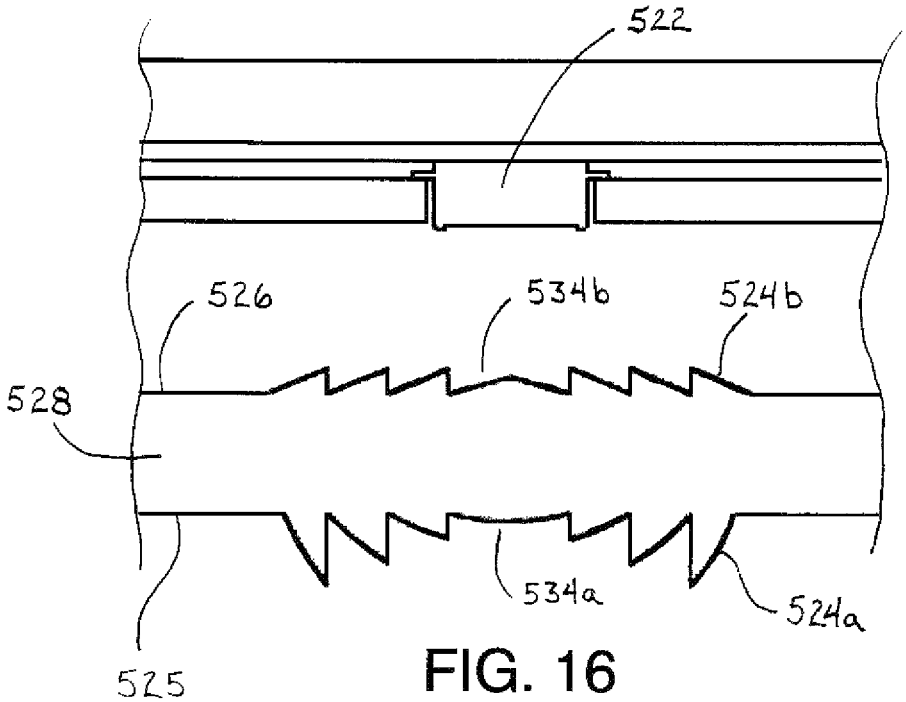
FIG. 16 is a close up partial side sectional view of yet another alternative optical structure in accordance with the present invention relative to an LED.

FIG. 15 discloses one example of an alternative optical light structure 424 aligned with LED 422, with optical light structure 424 configured as a Fresnel optical structure on the inner surface 426 of front cover 428 having multiple concentric annular sections. As illustrated, LED 422 is axially aligned with optical light structure 424, and receptacle 434 of optical structure 424, where receptacle 434 is the central portion of optical structure 424 and the concentric annular sections of optical structure form protuberances around receptacle 434. Still further, an LED light unit in accordance with the present invention may have a front cover including optical structures on both the inner surface and outer surface. One example of such a configuration is illustrated in FIG. 16, wherein optical structure 524*a* is located on the outer surface 525 of front cover 528 and optical structure 524*b* is located on the inner surface 526. In the embodiment of FIG. 16, optical structure 524*a* is a Fresnel optical structure and optical structure 524*b* is a refractive optic in which the concentric annular sections do not include a radius. As illustrated, optical structure 524*a*, optical structure 524*b*, and LED 522 are all axially aligned, with LED 522 projecting light at receptacle 534*a* of optical structure 524*a*, and in turn projecting through front cover 528 at receptacle 534*b* of optical structure 524*b*. Although not shown, yet another alternative configuration includes a front cover wherein the optical structure is located on the outer or outside surface of the front cover without an optical structure on the inner surface of the front cover.

In back mounted or reverse mounted configurations, LED lights may be configured to be generally flush with the circuit board to which they are mounted, as discussed above, or may alternatively be recessed within the apertures or may extend out of the apertures of the circuit board toward an optical structure. This configuration may be dependent, at least in part, on the thickness of the circuit board design, which in turn may be dependent on the circuit board material. For example, as an alternative to a glass reinforced epoxy laminate circuit board material, a flex circuit may be utilized, such as produced from mylar or the like, or a circuit board may be formed on an aluminum member, such as a 0.5 mm thick aluminum sheet. It should be further understood that a light module may be constructed that does not include a separate back cover and/or heat sink. For example, in the case of a circuit board constructed from an aluminum member or sheet, the circuit board itself may sufficiently dissipate heat such that a separate heat sink is not necessary. In such a construction, a separate back cover may also be unnecessary. Likewise, in the case of a flexible circuit having a copper pad adjacent an LED light, the copper pad may sufficiently dissipate heat without the need for a separate heat sink. In either of these embodiments, a separate back cover may optionally be included if desired, and might even be constructed from a cardboard, plastic, or other material. A light module may alternatively employ LED lights that are not back mounted to a circuit board.

Optical structures may be configured and spaced from a circuit board such that LED lights extending out of a given aperture actually extend into a given receptacle of an optical structure. In such a configuration, the diameter of receptacle opening would be sized sufficiently to accommodate the extension of at least a portion of the LED light into the receptacle. Alternatively sized, shaped and configured LED lights may also be employed other than LED lights having a circular cross section, such as LED lights 22 above. For example, a generally square shaped LED, or an LED having a square portion with a bulbous, dome projection may be used, as well as LED lights having different diameters. In certain embodiments, the gap or spacing between the outer periphery of the LED light and the circuit board aperture may be in the range of approximately 0.05 to 0.15 mm.

Front covers or front cover assemblies in accordance with the present invention may be formed of a plastic or glass material and may include color tinting. As an alternative to a back cover constructed of a metallic material and operating as a heat sink, a back cover may be constructed of glass or plastic to which a heat sink is applied. For example, a heat sink constructed of aluminum foil or a metallic silk screen may be applied to a glass member. A light module in accordance with the present invention may be battery powered and, although not shown, may be rechargeable through a universal serial bus ("USB") connection, or may include a USB connection for powering without including a battery.

Light modules including LED lights that are optically aligned with receptacles of optical structures decrease the waste of light caused by the divergence of projected light, thereby improving the efficiency of the light module by capturing, directing, and/or channeling projected light through the front cover to provide an acceptable lighting structure for a given application with a minimized cost. The LED lights may be optically aligned with and mounted in substantial proximity to the optical structures such that projected light is directed into a receptacle of the optical structure for directing or channeling the projected light through the front cover. Light module thus provides a compact and efficient device for illuminating distally located objects that may be used, for example, as an under cabinet light, a recessed ceiling or wall light, an appliance light unit, or other such lighting unit, and may be installed as original equipment or may be retrofitted to existing structures and surfaces.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which we claim an exclusive property or privilege are as follows:

1. A modular LED light unit for mounting to an object to illuminate objects distally located from said light unit, said light unit comprising:

a circuit board supporting a plurality of LED lights, said circuit board being planar and having a back side and a front side and including a plurality of apertures with said LED lights being reverse mounted to said back side of said circuit board such that each said LED light is located by and extends into a separate one of said apertures with said apertures being sized to axially align each said LED light with a corresponding said aperture into which said LED light extends such that said LED lights are positioned in axial alignment with said apertures; and a light permeable front cover having an outer surface and an inner surface, said front cover including at least one optical structure, said at least one optical structure being located on one of said outer surface and said inner surface of said front cover, and wherein no part of said front cover extends into any of said apertures;

wherein said circuit board and said front cover are assembled together to be in engagement such that said apertures are axially aligned with said at least one optical structure whereby light emitted from said LED lights is directed into said at least one optical structure.

2. The modular LED light unit of claim 1, wherein one of said circuit board or said front cover include an alignment member that is separate from said at least one optical structure, with said circuit board and said front cover being assembled together such that said alignment member engages with the other of said circuit board or said front cover to axially align said apertures with said at least one optical structure.

3. The modular LED light unit of claim 2, wherein a portion of said LED lights extending into a respective said aperture is in substantial proximity to said circuit board at said aperture with respect to a cross sectional dimension of said portion of said LED light extending into said aperture and a cross sectional dimension of said aperture to axially align said LED light with said aperture.

4. The modular LED light unit of claim 1, further comprising a plurality of optical structures, and wherein each said optical structure is aligned with and in substantial proximity with at least one of said LED lights.

5. The modular LED light unit of claim 4, wherein each said optical structure is aligned with and in substantial proximity to a separate one of said LED lights.

6. The modular LED light unit of claim 1, further including a back cover and each said LED light including a back surface, wherein said back cover comprises a heat sink thermally contacting said back surfaces of said LED lights.

7. The modular LED light unit of claim 1, wherein one of said front cover or said circuit board includes an alignment member that is separate from said at least one optical structure, and the other of said front cover and said circuit board includes an alignment aperture without a said LED light extending into said alignment aperture, and wherein said alignment member projects into said alignment aperture to locate said front cover relative to said circuit board.

8. The modular LED light unit of claim 7, wherein said alignment aperture is located on said circuit board and said alignment member comprises a pin located on said front cover, and wherein said pin extends upward from said inner surface of said front cover and projects into said alignment aperture of said circuit board.

9. The modular LED light unit of claim 1, wherein said apertures define a circular opening and said LED lights have a circular profile, and wherein the diametrical clearance of said LED lights relative to said apertures is approximately 0.1 to 0.3 mm.

10. The modular LED light unit of claim 1, wherein said at least one optical structure defines a protuberance on said inner surface of said front cover that protrudes toward said circuit board, and wherein said protuberance does not protrude toward said circuit board beyond said front side of said circuit board.

11. The modular LED light unit of claim 1, wherein said LED lights include a light emitting end, and wherein said light emitting ends of said LED lights are generally flush with said front side of said circuit board facing said front cover.

12. The modular LED light unit of claim 11, wherein said LED lights contact said optical structures.

13. The modular LED light unit of claim 1, wherein a portion of said LED lights extending into a respective said aperture is in substantial proximity to said circuit board at said aperture with respect to a cross sectional dimension of said portion of said LED light extending into said aperture and a cross sectional dimension of said aperture to axially align said LED light with said aperture.

14. The modular LED light unit of claim 13, wherein said cross sectional dimension of said aperture and said cross sectional dimension of said portion of said LED light extending into said aperture define a cross dimensional clearance of said LED lights relative to said apertures that is less than approximately 0.3 mm.

15. A modular LED light unit for mounting to an object to illuminate objects distally located from said light unit, said light unit comprising:

a circuit board supporting a plurality of LED lights, with each said LED light having a back surface and said circuit board being planar and having a back side and a front side and including a plurality of apertures with said LED lights being reverse mounted to said back side of said circuit board such that each said LED light is located by and extends into a separate one of said apertures with said apertures being sized to axially align each said LED light with a corresponding said aperture into which said LED light extends such that said LED lights are positioned in axial alignment with said apertures;

a heat sink thermally contacting said back surfaces of said LED lights;

a light permeable front cover having an outer surface and an inner surface, said front cover including at least one optical structure, said at least one optical structure being located on one of said outer surface and said inner surface of said front cover, and wherein no part of said front cover extends into any of said apertures;

at least one of said LED lights being axially aligned with said at least one optical structure whereby light emitted from said at least one of said LED lights is directed into said optical structure; and one of said front cover or said circuit board including an alignment member that is separate from said at least one optical structure and the other of said front cover and said circuit board including an alignment aperture without a said LED light extending into said alignment aperture, and wherein said alignment member projects into said alignment aperture to locate said front cover relative to said circuit board.

16. The modular LED light unit of claim 15, wherein said at least one optical structure defines a protuberance on said inner surface of said front cover that protrudes toward said circuit board, and wherein said protuberance does not protrude beyond said front side of said circuit board.

17. The modular LED light unit of claim 15, wherein said apertures define openings and wherein the cross dimensional clearance of said LED lights relative to said apertures at said openings is less than approximately 0.3 mm.

18. The modular LED light unit of claim 15, wherein said light unit is approximately 7 mm thick.

19. A modular LED light unit for mounting to an object to illuminate objects distally located from said light unit, said light unit comprising:

a circuit board supporting a plurality of LED lights, with each said LED light having a back surface and said circuit board being planar and having a back side and a front side and including a plurality of apertures with said LED lights being reverse mounted to said back side of said circuit board such that each said LED light is located by and extends into a separate one of said apertures with said apertures being sized to axially align each said LED light with a corresponding said aperture into which said LED light extends such that said LED lights are positioned in axial alignment with said apertures;

a heat sink, said heat sink thermally contacting said back surfaces of said LED lights with said heat sink defining a back cover of said light unit;

a light permeable front cover having an outer surface and an inner surface, said front cover including at least one optical structure on said inner surface of said front cover and wherein no part of said optical structure extends into any of said apertures;

at least one of said LED lights being axially aligned with said at least one optical structure whereby light emitted from said at least one of said LED lights is directed into said optical structure; and one of said front cover or said circuit board including an alignment member that is separate from said at least one optical structure and the other of said front cover and said circuit board including an alignment aperture without a said LED light extending into said alignment aperture, and wherein said alignment member projects into said alignment aperture to locate said front cover relative to said circuit board.

20. The modular LED light unit of claim 19, wherein said at least one optical structure defines a protuberance relative to said inner surface protruding toward said circuit board, wherein said protuberance does not protrude beyond said front side of said circuit board, and wherein said at least one optical structure includes a receptacle defining a void in said optical structure with said receptacle including a receptacle opening.

21. The modular LED light unit of claim 20, further comprising a plurality of optical structures, and wherein each receptacle of each said optical structure is aligned with and in substantial proximity to at least one of said LED lights.

22. The modular LED light unit of claim 19, wherein said light unit has a thickness of approximately 7 mm.

* * * * *

UNITED STATES PATENT AND TRADEMARK OFFICE

CERTIFICATE OF CORRECTION

PATENT NO. : 8,813,399 B2
APPLICATION NO. : 13/020851
DATED : August 26, 2014
INVENTOR(S) : Gregory A. Miedema and Denis P. Igoe It is certified that error appears in the above-identified patent and that said Letters Patent is hereby corrected as shown below:

In the Specification,

Column 2
Line 65, "0.3μm" should be --0.3mm--

Signed and Sealed this
Fifteenth Day of September, 2015

Michelle K. Lee

Michelle K. Lee
*Director of the United States Patent and Trademark Office*